US012668389B2

(12) United States Patent
Soria et al.

(10) Patent No.: US 12,668,389 B2
(45) Date of Patent: Jun. 30, 2026

(54) GASSING RAIL AND GAS PORT FOR FOOD PACKAGING

(71) Applicant: Excel Packaging Consulting, LLC, Big Rock, IL (US)

(72) Inventors: Francisco J. Soria, Big Rock, IL (US); Koon H. Wong, Wheeling, IL (US)

( * ) Notice: Subject to any disclaimer, the term of this patent is extended or adjusted under 35 U.S.C. 154(b) by 295 days.

(21) Appl. No.: 18/228,274

(22) Filed: Jul. 31, 2023

(65) Prior Publication Data

US 2025/0042588 A1 Feb. 6, 2025

(51) Int. Cl.
*B65B 31/04* (2006.01)

(52) U.S. Cl.
CPC ..... *B65B 31/041* (2013.01)

(58) Field of Classification Search
CPC ..... B65B 31/041
See application file for complete search history.

(56) References Cited

U.S. PATENT DOCUMENTS 5,682,723 A 11/1997 Nowotarski
5,816,024 A * 10/1998 Sanfilippo ..... B65B 31/00 53/510
5,911,249 A * 6/1999 Sanfilippo ..... B67C 3/222 141/70
6,032,438 A * 3/2000 Sanfilippo ..... B65B 31/00 141/70
6,691,747 B1 * 2/2004 Marcus ..... B65B 31/041 141/54
7,690,404 B2 * 4/2010 Marcus ..... B65B 31/041 141/85
8,430,341 B2 * 4/2013 Marcus ..... B65B 31/00 141/286
10,934,036 B2 * 3/2021 Nowaczyk ..... F28F 9/0221
2006/0231156 A1 * 10/2006 Marcus ..... B65B 31/041 141/64
2006/0231157 A1 * 10/2006 Marcus ..... B65B 31/041 141/85

OTHER PUBLICATIONS

United Kingdom Intellectual Property Office, Search Report, Nov. 12, 2024, patent application GB2410980.3, United Kingdom.

* cited by examiner

*Primary Examiner* — Eyamindae C Jallow
(74) *Attorney, Agent, or Firm* — IpHorgan Ltd.

(57) ABSTRACT

A gassing rail apparatus is provided to be used in a food packaging conveyor system. The gassing rail apparatus includes a rail top, a first and second gas port, an insert assembly located below the rail top, a gassing element located below the insert assembly, a rail bottom located below the gassing element, wherein the gas flowing through a slit in the insert assembly produces a high speed accelerated flow, and a flow of laminar gas is blocked by the rail bottom and forces the laminar gas flow laterally within the layer of gas resistant media of the gassing element with the effect of surrounding the accelerated gas exiting the gas distribution slot, wherein the accelerated gas tends to draw in laminar gas and not undesirable air, and the first gas source provides about 15-25% of the gas provided to the gassing rail apparatus and the second gas source provides about 75-85% of the gas provided to the gassing rail apparatus. In another embodiment, a single gas port is provided.

22 Claims, 15 Drawing Sheets

GASSING RAIL AND GAS PORT FOR FOOD PACKAGING

FIELD OF THE INVENTION

The present invention relates to accelerated gassing rail assembly for flushing gas during packaging process.

BACKGROUND OF THE INVENTION

The prior art includes a system and process of packaging food items.

U.S. Pat. No. 10,934,036 is directed to an apparatus and method for distributing a flushing gas. In the background of the invention, reference is made to certain granular or particulate-form food products, such as ground coffee. FIG. 2*a* discloses a plenum which includes a longitudinal manifold and a covering plate. The covering plate includes a plurality of through slits. FIG. 3 is a sectional view of the plenum configured to provide a turbulent gas flow. FIG. 5 is a sectional view of the plenum, conveyor segment and container configured to provide a turbulent gas flow. The size of the slits and their orientation and location along the covering plate causes the flushing gas to turbulently enter the interior of the container and mix with the undesirable gases present therein. The turbulent flow of the flushing gas into the container thus ensures both a complete mixture with the undesirable gases located therein and the complete, eventual displacement of the gas mixture therefrom until only the flushing gas itself remains present.

U.S. Pat. No. 5,682,723 is directed to a turbo-laminar purging system. In column 1, it is disclosed that an object of the invention is to provide an improved system for processing containers in which high velocity turbulent flow purge gas is supplied to purge the containers and a low velocity laminar flow of the purging gas is used to reduce infiltration of air into the tunnel. FIG. 1 is a schematic view of a purging tunnel along its length, and is shown to include tunnel, turbulent purge gas injectors, laminar gas flow injector and containers. Column 3 discloses that the open containers entering the tunnel at entrance can be already filled with product or the product can be dispensed into the containers as they enter the tunnel. Located within the tunnel somewhat below its roof is a turbulent purge gas injector, here shown being in two separate sections. The gas injectors are supplied with the purging gas, for example, argon or nitrogen, from a suitable source for injection directly into the open tops of the containers as they pass below the injector. The injector outlets are preferably relatively close to the container open tops. A simple injector for producing turbulent gas flow is a pipe with a row of holes. The open part of the containers are exposed to the turbulent purge gas flow for at least 50 percent of the residence time, preferably at least 70 percent of the residence time. Column 7 discloses that cylindrical shaped cans, 3" in diameter and 3, 4, 5 or 6" high, of potato crisps were passed through the tunnel. The residence (total passage) time of each can in (through) the tunnel was 10 seconds. After the cans passed through the tunnel, they were sealed and the residual oxygen in the cans was measured. For this application it was desired to reduce the oxygen content in the containers to 1.5% or less. The results are given in Table II. In the absence of turbulent flow, with as high as about 14,000 cfh of laminar purge gas flow, the larger containers could not be adequately purged. When the turbulent gas flow was 600 cfh, however, only about 3600 cfh of total purge gas flow was required to lower the oxygen level in all containers to less than 1.5%. The purging was even more effective for the larger containers than it was for the smaller ones. More turbulent flow is required with a shorter residence time of the cans in the tunnel. Also, a greater turbulent flow would be required if the turbulent injector holes were larger or more numerous.

U.S. Pat. No. 5,911,249 discloses a gassing rail apparatus and method. FIG. 3 is an exploded view of a preferred gassing rail embodiment. Gassing rail includes rail top and rail base, and gassing elements. The rail top is made of a rigid material. Preferably, for the embodiment shown in FIG. 3, the rail top is made of plastic. The rail base is also made of a rigid material, preferably stainless steel or aluminum. The bottom surface of the base remains an unbroken smooth surface except for the open regions. The studs include threaded openings to receive thumb screws 64, which are inserted through openings formed in the rail top and retained with retaining washers. The studs and rail top openings are, for the preferred embodiment shown, are spaced in pairs along the rail.

U.S. Pat. Nos. 10,934,036, 5,682,723 and 5,911,249, are each incorporated herein by reference.

The prior art all provide some sort of accelerated flow only. Because of the high speed accelerated flow, the prior art draws air from the surrounding area into the container, resulting in mixing desirable gas with the surrounding air. The efficiency results in being lower.

There is a need to achieve low oxygen percentage inside the container, in particular for a tall container, in a shorter period of time. In addition, it is desirable for provide such a system with reduced complexity and parts, and to improve efficiency.

SUMMARY OF THE INVENTION

The present invention provides a gassing rail apparatus to be used in a food packaging conveyor system. The gassing rail apparatus adapted to be coupled to a first gas source and a second gas source and includes a rail top, the rail top having an upper portion with a laminar flow port opening and an accelerated flow port opening, and a lower portion having a laminar flow channel and an accelerated flow channel, the channels extending longitudinally in a parallel arrangement, the laminar flow port opening coupled to the laminar flow channel and the accelerated flow port opening coupled to the accelerated flow channel, a first gas port coupled to the laminar flow port opening, the first gas port is adapted for coupling to a first gas source, a second gas port coupled to the accelerated flow port opening, the second gas port is adapted for coupling to a second gas source, an insert assembly located below the rail top and having an upper portion and a lower portion, the upper portion includes a laminar flow input generally aligned with the laminar flow channel, and a slit extending generally parallel to the laminar flow input and generally aligned with the accelerated flow channel, the slit having an inlet in the upper surface of the insert assembly and an outlet in the lower portion, a longitudinally extending laminar chamber is provided in the lower portion and is in fluid communication with the laminar flow input, a gassing element located below the insert assembly and having a layer of gas resistant media of stainless-steel mesh, the gassing element includes one or more slots for laminar flow which are at least partially aligned with the laminar chamber located above, and one or more slots for accelerated flow which is aligned with the slit located above, a rail bottom located below the gassing element, the rail bottom having at least one gas distribution slot, the at least one gas distribution slot extending along the longitudinal axis of the rail bottom, and is aligned with the accelerated flow slots of the gassing element and at least partially blocks the laminar flow slots of the gassing element, wherein the gas flowing through the slit produces a high speed accelerated flow, and the flow of laminar gas blocked by the rail bottom forces the laminar gas flow laterally within the layer of gas resistant media of the gassing element with the effect of surrounding the accelerated gas exiting the gas distribution slot, wherein the accelerated gas tends to draw in laminar gas and not undesirable air, and the first gas source provides about 15-25% of the gas provided to the gassing rail apparatus and the second gas source provides about 75-85% of the gas provided to the gassing rail apparatus. In another embodiment, a single gas port is provided. A method of displacing undesirable gas is also provided.

DETAILED DESCRIPTION OF THE INVENTION

Figure 1:
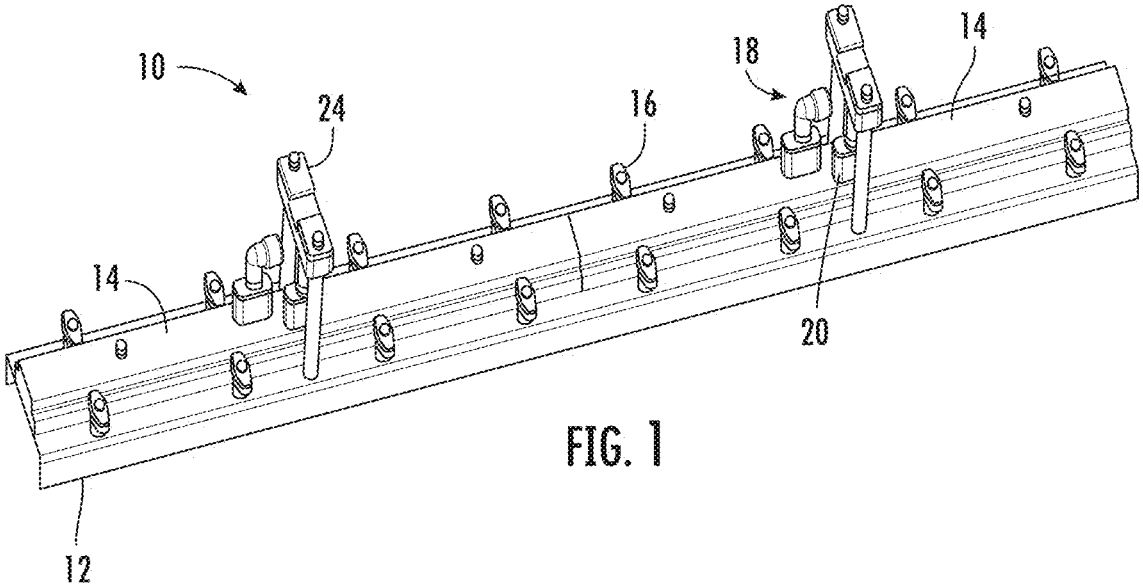
FIG. 1 is a perspective view of a gassing rail assembly in accordance with a first embodiment of the present invention.
Figure 2:
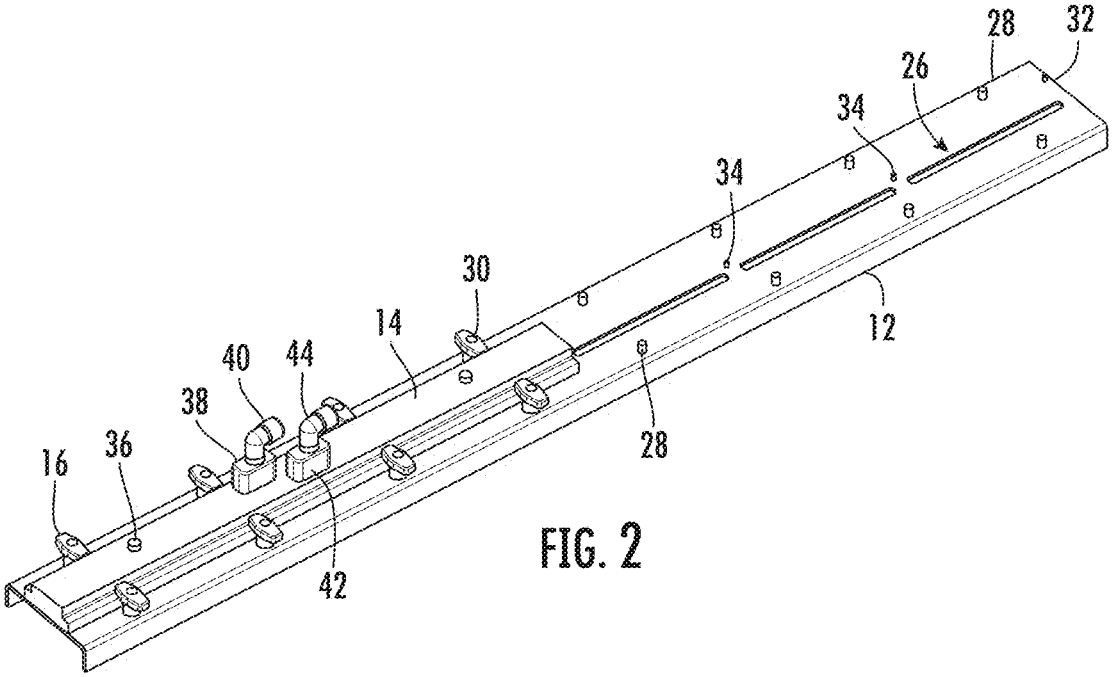
FIG. 2 is a perspective view of a gassing rail assembly of FIG. 1, wherein one of the top rail assemblies is omitted.

FIG. 1 is a perspective view of a gassing rail assembly 10 in accordance with a first embodiment. The gassing rail assembly 10 includes a rail base or bottom 12, upon which is two rail top or manifold assemblies 14 mounted end-to-end. Each rail top assembly 14 is secured to the rail bottom 12 via a plurality of rotating locking arms 16. A gas attachment 18 for laminar flow and a gas attachment 20 for accelerated flow are coupled to the rail top assembly 14. A mounting fixture 24 is secured to the rail top assembly 14. A first hose (not shown) is used to couple a first gas source (not shown) to the laminar gas attachment 18. A second hose (not shown) is used to couple a second gas source (not shown) to the accelerated gas attachment 20. As is known in the art, the first gas source is adapted for providing an inert gas, such as nitrogen, having a laminar flow. The second gas source is adapted for providing an inert gas having an accelerated flow. The mounting fixture 24 is used to stabilize and secure the gas hoses. FIG. 2 is a perspective view of the gassing rail assembly 10 of FIG. 1, wherein one of the rail top assemblies 14 is omitted for a better understanding of the invention. It can be seen that the right half of the rail bottom 12 includes three slots or gas distribution openings 26. The three slots 26 are aligned end-to-end. However, as can be seen, the slots 26 do not extend down the middle of the rail bottom 12. Rather, the slots 26 are offset from the longitudinal center of the rail bottom 12. Eight studs 28 are shown secured to the rail bottom 12 via welding or other means. The studs 28 include threaded upper openings to receive a respective fastener or screw 30 for securing a respective rotating locking arm 16. An orientation stud 32 is shown and is received by the rail top assembly 14. Two gassing element alignment studs 34 are shown extending from the upper surface of the rail bottom 12. Two fasteners 36 are shown extending through the rail top assembly 14. The laminar flow gas attachment 18 includes a port block 38 and a port fitting 40. The accelerated flow gas attachment 20 includes a port block 42 and a port fitting 44.

Figure 3:
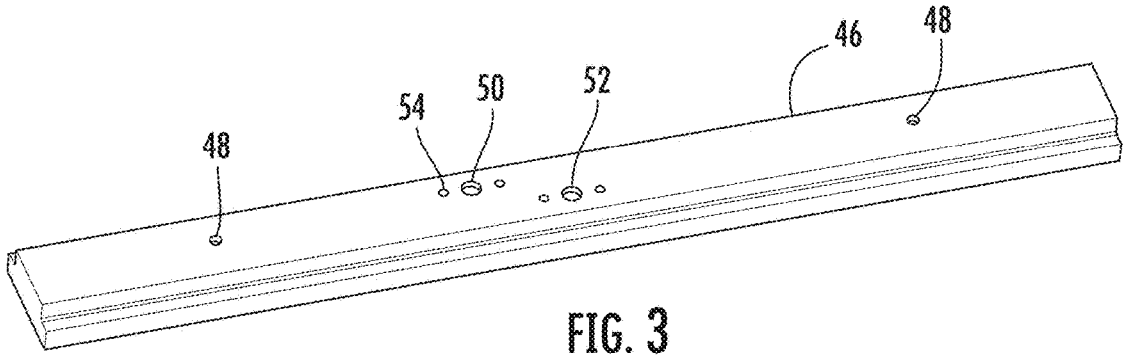
FIG. 3 shows a perspective view of the rail top or manifold shown in FIGS. 1 and 2.
Figure 4:
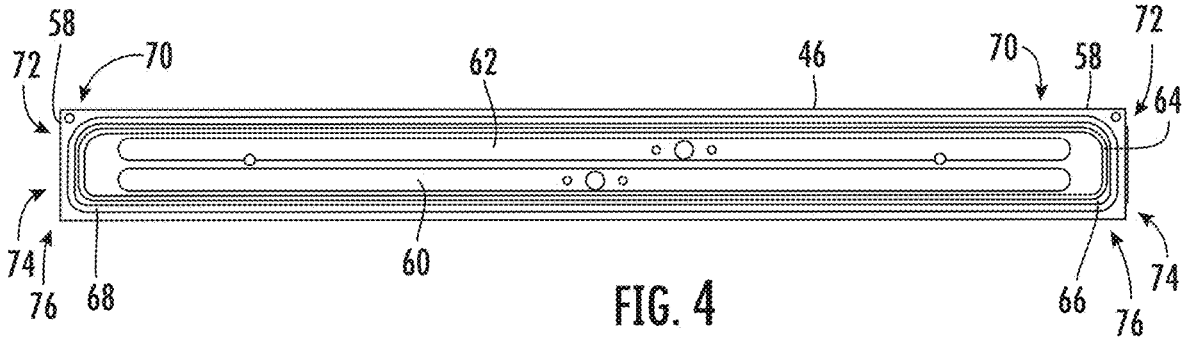
FIG. 4 shows a bottom view of the rail top of FIG. 3.

FIG. 3 shows a perspective view of the rail top or manifold 46 shown in FIGS. 1 and 2. The rail top 46 includes two through-holes 48 which receive a respective fastener 36. A laminar flow port opening 50 and an accelerated flow port opening 52 extend through the top surface of the rail top 46. Through-holes 54 receive a respective fastener 56 for securing the respective port blocks 38, 42 to the rail top 46. FIG. 4 shows a bottom view of the rail top 46. Blind bores 58 provided in the rail top 46 receive a respective orientation stud 32. The rail top 46 includes a laminar flow channel 60 and an accelerated flow channel 62 which extend parallel to one another along respective sides of the rail top 46. The rail top 46 includes an inner landing or seat 64, an intermediate landing or seat 66 and an outer landing or seat 68. Each seat is shown forming a generally rectangular shape, wherein two of the corners 70 are formed with a first radius 72 and the other two corners 74 are formed with a second radius 76, so as to form an orientation or keying feature as described further below.

Figure 5:
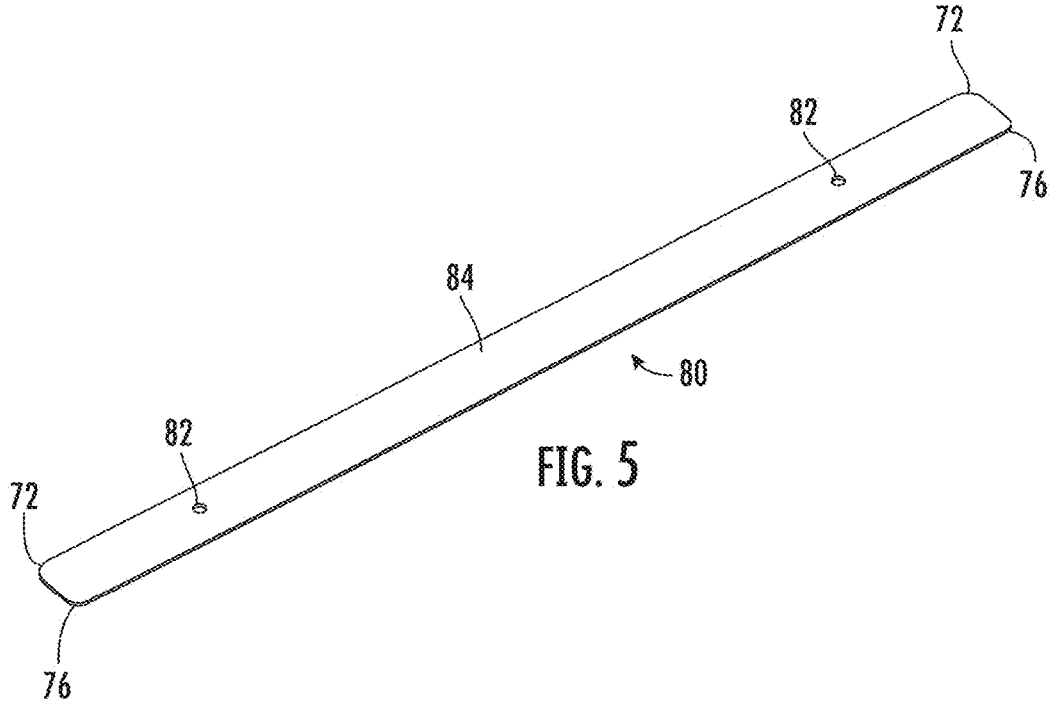
FIG. 5 shows a perspective view of the of the mesh baffle.
Figure 6:
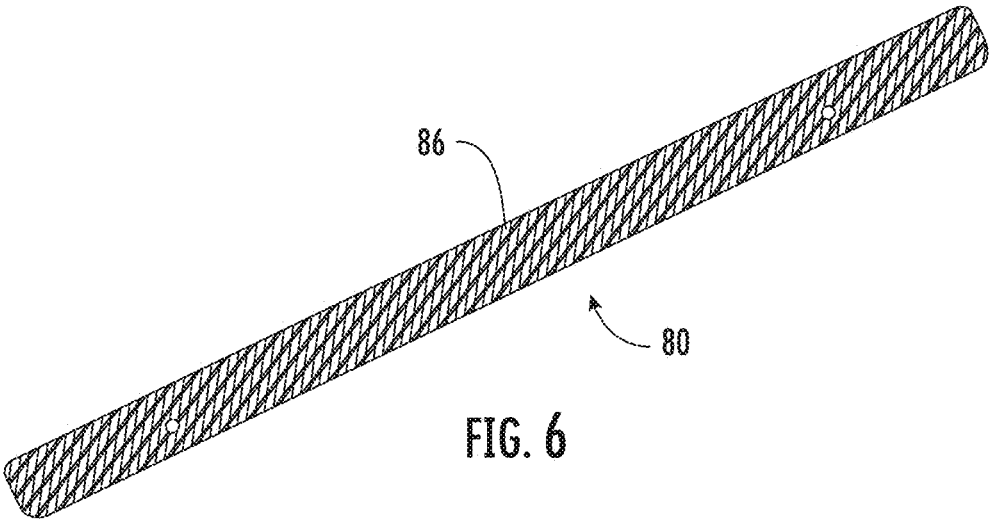
FIG. 6 shows a bottom view of the mesh baffle.

FIG. 5 shows a perspective top view of the mesh baffle 80 having through-holes 82 and a top portion 84. FIG. 6 shows a bottom view of the mesh baffle 80 having a bottom portion 86. The mesh baffle 80 is a multi-layer single piece stainless steel mesh. In this embodiment, one side is fine and the opposite side is coarse. The fine side faces outward so that product powder does not enter the rail top and port block. The mesh baffle 80 includes two corners having a first radius 72 and two corners having a second radius 76.

Figure 7:
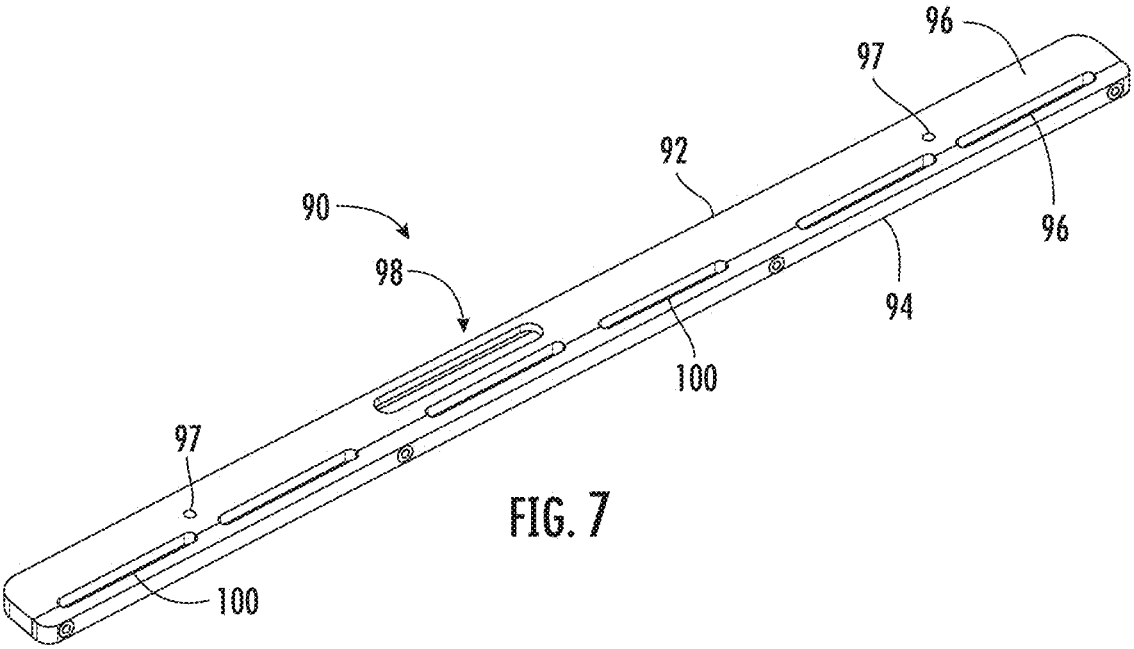
FIG. 7 shows a perspective top view of the insert assembly.
Figure 8:
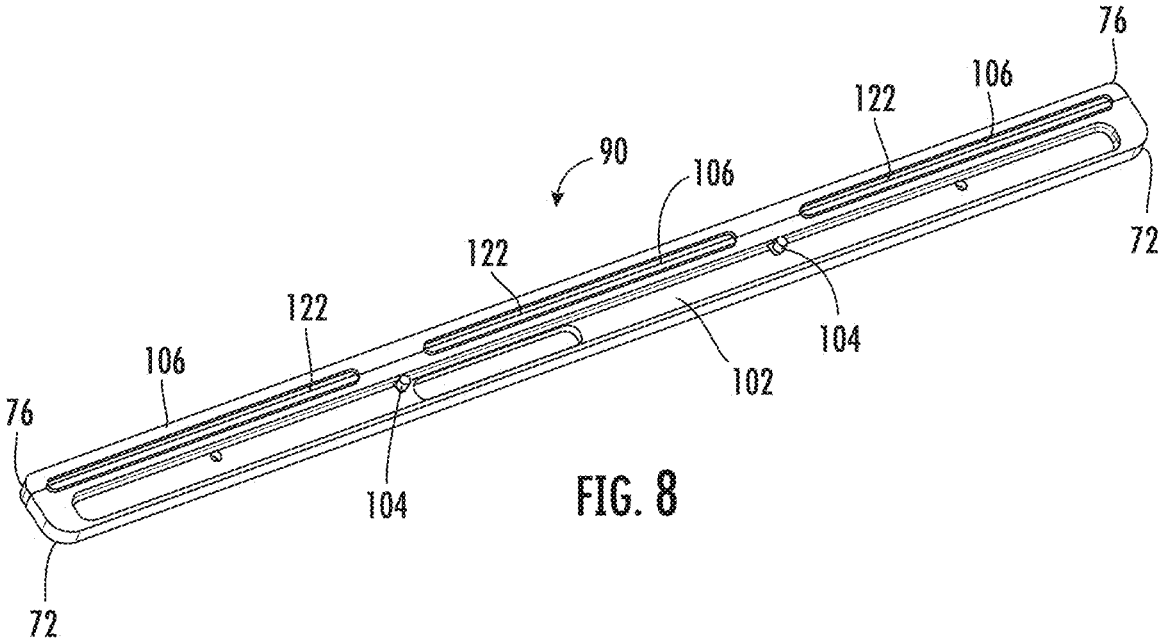
FIG. 8 shows a bottom perspective view of the insert assembly of FIG. 7.
Figure 9:
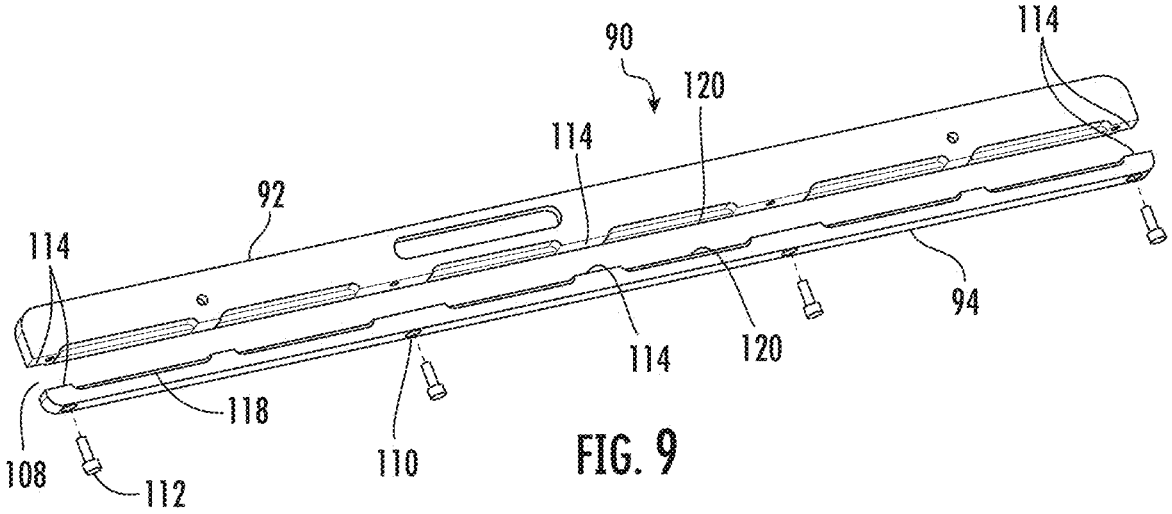
FIG. 9 is a top exploded view of the insert assembly of FIG. 7.

FIG. 7 shows a perspective top view of the insert assembly 90 which includes a first or laminar portion 92 and a second or accelerated portion 94. The insert assembly 90 forms a top surface 96. Threaded openings 97 are provided at the top surface 96 and receive respective fastener 36. An input slot 98 for receiving gas having laminar flow is provided in the top surface 96. Six input slots 100 for receiving gas having an accelerated flow are provided in the top surface 96. FIG. 8 shows a bottom perspective view of the insert assembly 90 and shows that the laminar flow input slot 98 opens to a laminar flow chamber 102. Centering studs 104 extend from the insert assembly 90. The six input slots 100 merge into three output slots 106 for the gas having accelerate flow to exit the insert assembly 90. FIG. 9 is a top exploded view of the insert assembly 90 and shows four threaded openings 108 in the laminar portion 92 and four openings 110 in the accelerated portion 94. The laminar portion 92 and the accelerated portion 94 are secured together via fasteners 112. The upper portion of the insert assembly 90 includes seven pairs of abutting walls 114 which form the six input slots 100. The seven pairs of abutting walls 114 extend from the top surface 96 to the bottom surface 116. The upper portion of the insert assembly 90 includes six sets of opposed upper facing walls 118 spaced apart a first distance. The lower portion of the insert assembly 90 includes six set of lower facing walls 120 spaced apart so as to form a slit 122 having a width of about 25 mm. Although the insert assembly 90 may take other forms, it is desired that the insert assembly 90 channel the incoming gas having an accelerated flow to pass through slits 122 having a width of approximately 0.25 mm or in a range of 25 mm to 1 mm. The insert assembly 90 includes two corners having a first radius 72 and two corners having a second radius 76. Accelerated flow comes from the slit 122 of the insert assembly 90. The 0.25 mm slits provide high speed accelerated flow. The two portions 92, 94 of the insert assembly 90 may be easily separated for cleaning.

Figure 10:
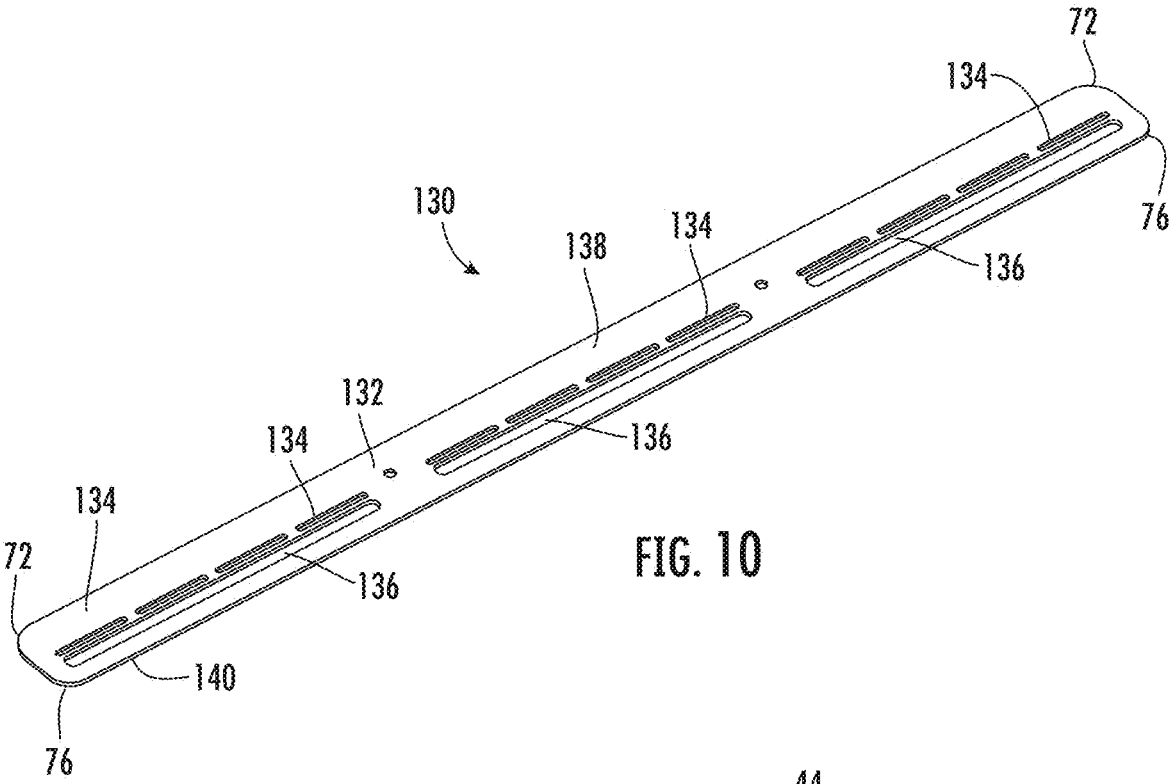
FIG. 10 shows a top perspective view of the gassing element or wire screen.

FIG. 10 shows a top perspective view of the gassing element or wire screen 130. Two through-holes 132 are provided for alignment with the rail bottom 12. Three sets of four slots 134 are provided for gas having laminar flow. Three slots 136 are provided for gas having accelerated flow. The laminar flow slots 134 extend generally centrally along the axis of the gassing element 130. The accelerated flow slots 136 are wider than the laminar flow slots 134. The gassing element 130 includes a top layer 138 and a bottom layer 140 of stainless steel mesh and may be secured together via welding or the like. The top layer 138 and the bottom layer 140 define a similar perimeter dimension, however, the bottom layer 140 does not include the slots 134, 136. The top layer 138 provides a denser media or less porous media than the bottom layer 140 and is a gas resistant media. For example, the top layer 138 may provide a 5-ply mesh while the bottom layer 140 is 2-ply mesh. Laminar flow is provided by the 5-ply layer. The solid rail bottom 12 blocks the downward flow of laminar flow from the slots 134 in the gassing element 130 and forces the laminar flow laterally within the 5-ply layer until each reaches the perimeter of the three accelerated slots 136 and exits the gas distribution opening 26. The three accelerated slots 136 are aligned with the gas distribution opening 26 of the rail bottom 12. The purpose of the finer 2-ply mesh layer 140 is to provide protection of the slit 22 of the insert assembly 90 from product. For example, powder may stick to the coarse 5-ply layer in the absence of the 2-ply layer. The gassing element 130 includes two corners having a first radius 72 and two corners having a second radius 76.

Figure 11:
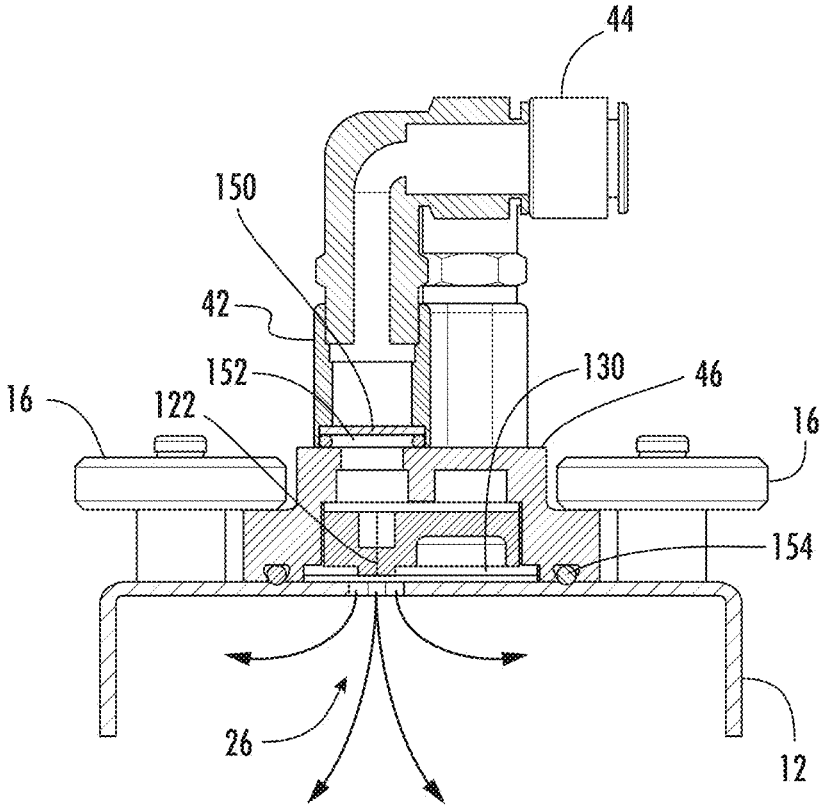
FIG. 11 is a cross section of the gassing rail assembly of FIG. 1 taken through the accelerated flow block.
Figure 12:
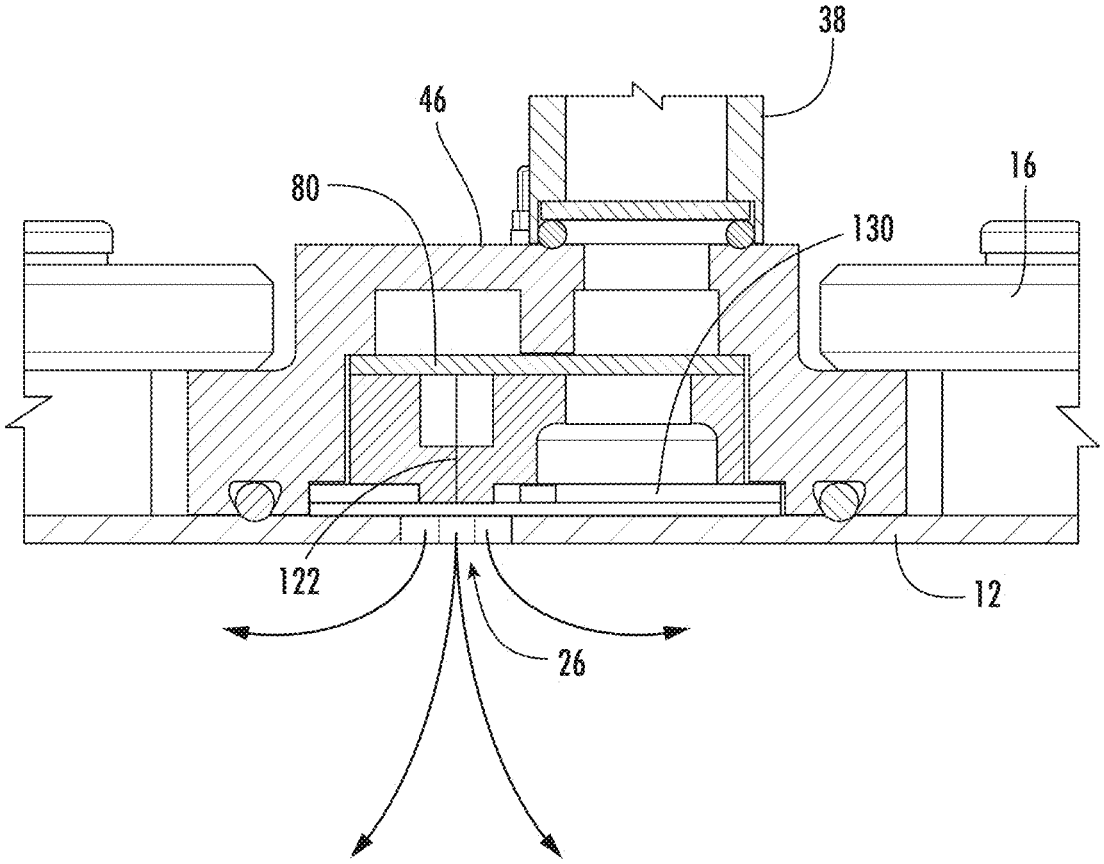
FIG. 12 is a cross section of the gassing rail assembly of FIG. 1 taken through the laminar flow block.
Figure 13:
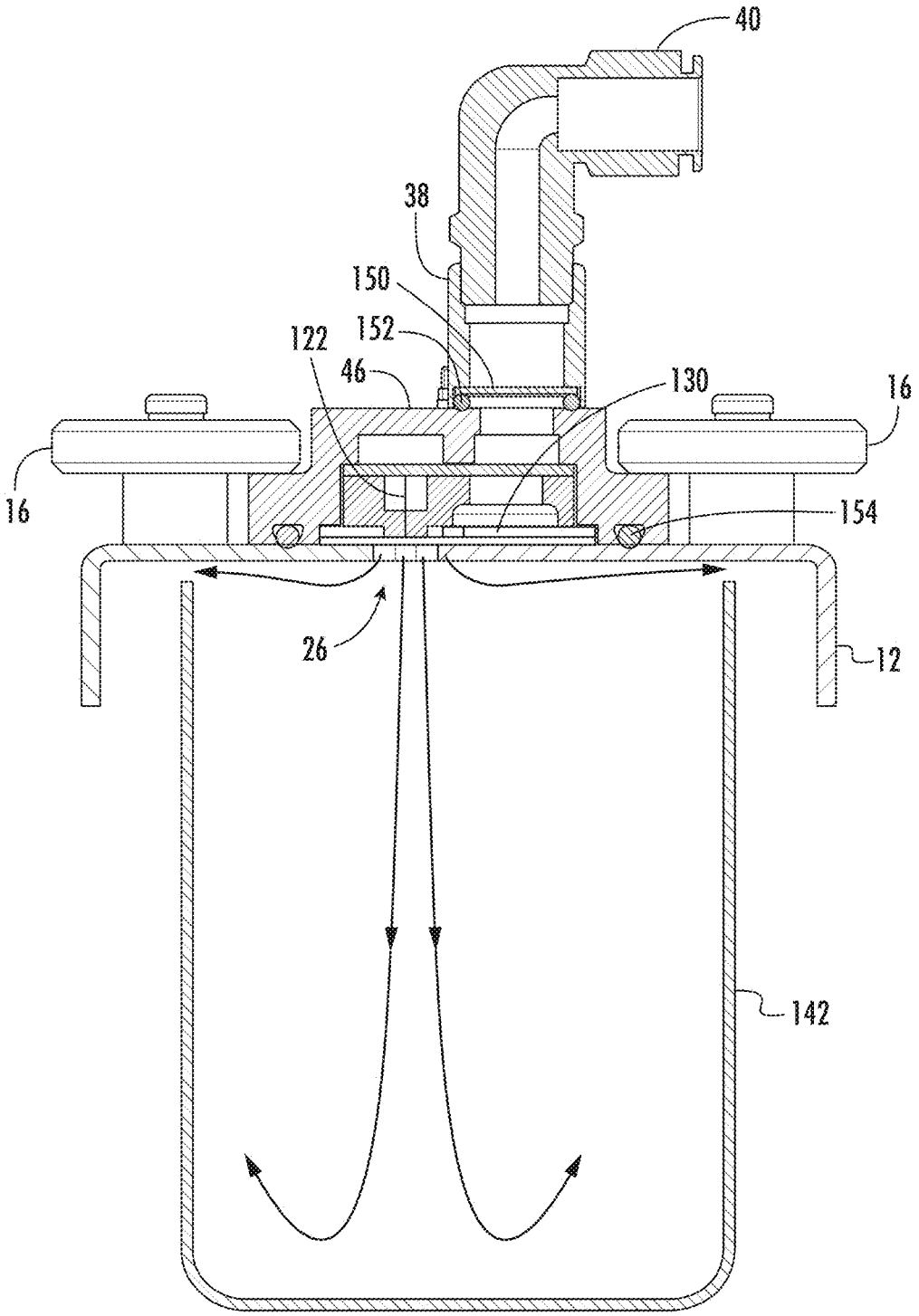
FIG. 13 is a cross section of the gassing rail assembly of FIG. 1 taken through the laminar flow block similar to FIG. 12 but including a cross section of a container.

FIG. 11 is a partial cross section of the gassing rail assembly 10 of FIG. 1 taken through the center of the accelerated port block 42, and for illustration purposes, wherein the accelerated port fitting 44 has been rotated 90 degrees. FIG. 12 is a partial cross section of the gassing rail assembly 10 of FIG. 1 taken through the center of the laminar port block 38. FIG. 13 is a partial enlarged view of the cross section of the gassing rail assembly of FIG. 1 taken through the laminar port block 38 similar to FIG. 12, and for illustration purposes, wherein the laminar port fitting 40 has been rotated 90 degrees and including a cross section of a container.

The port blocks 38, 42 each include port block baffle 150 and O-ring 152. The port block baffle 150 has a constructions similar to the mesh baffle 80. FIGS. 11-13 show the gasket 154 which seals the insert assembly 90 to the rail bottom 12.

It will be appreciated that the gassing rail assembly 10 provides gas having an accelerated flow from the slit 122 of the insert assembly 90 and exits the gas distribution opening 26 in the rail bottom 12. The gas having a laminar flow, provided generally from the 5-ply mesh of the gassing element 130, exits the gas distribution opening 26 generally surrounding the gas having accelerated flow, as depicted in FIGS. 11-13. The laminar flow is generally slow and smooth in comparison to the accelerated flow which is somewhat turbulent. The high speed accelerated flow is directed to the center of the container, while the laminar flow surrounds the accelerated flow in a cloud like manner. The high speed accelerated flow draws in the desirable gas of laminar flow into the container, instead of air. The assembly achieves low oxygen percentage inside the container within a short period of time. The laminar flow acts as a shield or blanket around the accelerated flow. The laminar flow tends to stabilize the accelerated flow.

Each port block is coupled to a source of inert gas, such as Nitrogen or the like, having a flow rate of about 300-400 CFH. The separate gas sources (not shown), coupled to respective the laminar port block 38 and the accelerated port block 42, are regulated in a manner as one skilled in the art will appreciated, so as to provide an effective ratio of accelerated and laminar gas flow. A preferred ratio is about 80% accelerated flow and 20% laminar flow exiting the respective port blocks. However, a range of effective ratio includes 60/40% to 85/15%. For control of the ratio, each source of gas flow is controlled independently.

The purpose of the mesh baffle 80 is to slow downward flow and allow more even downward distribution in a pattern similar to the elongated horizontal laminar and accelerated passages 60, 62 of the rail top 46. The solid rail bottom 12 blocks the downward laminar flow and forces the laminar flow of gas laterally within the 5-ply mesh of the gassing element 130, until it reaches the perimeter of the three longitudinal accelerated flow slots 136 in the gassing element 130 and exits the bottom rail 12 at the gas distribution opening 26. However, the slots 136 of the element 130 for accelerated flow of gas are aligned with the gas distribution opening 26 in the rail bottom 12. Unlike the prior art, the present invention provides both laminar flow and accelerated flow at the same time.

It will be understood that the keying feature assures that the various components are assembled in the correct orientation so that the flow passages are aligned as required.

Although an improvement over the prior art, the first embodiment requires two port attachments 18, 20, one for laminar flow and one for accelerated flow. In addition, the two port attachments 18, 20 require additional tubing and other related items. Further, the gas flow exiting the gas distribution opening 26 is off center of the longitudinal axis of the rail bottom 12 which complicates assembly.

Figure 14:
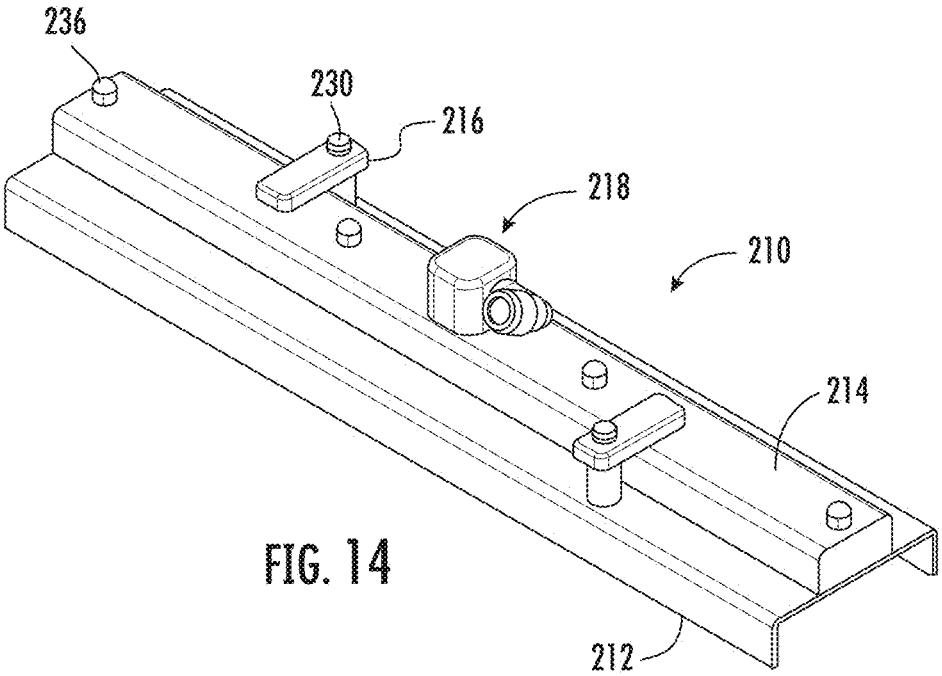
FIG. 14 is a perspective view of a gassing rail assembly in accordance with a second embodiment of the present invention.

FIG. 14 is a perspective view of a gassing rail assembly 210 in accordance with a second embodiment. The gassing rail assembly 210 includes a rail base or bottom 212, upon which a rail top or manifold assembly 214 is mounted. The rail top assembly 214 is secured to the rail bottom 212 via a plurality of rotating locking arms 216. A gas attachment 218 for laminar flow and accelerated flow is coupled to the rail top 214. A mounting fixture (not shown) may be secured to the rail top assembly 214 in a similar manner as in the first embodiment. A gas hose (not shown) is used to couple a single gas source (not shown) to the gas attachment 218. As is known in the art, the gas source is adapted for providing an inert gas, such as nitrogen. The mounting fixture is used to stabilize and secure the gas hose.

Figure 15:
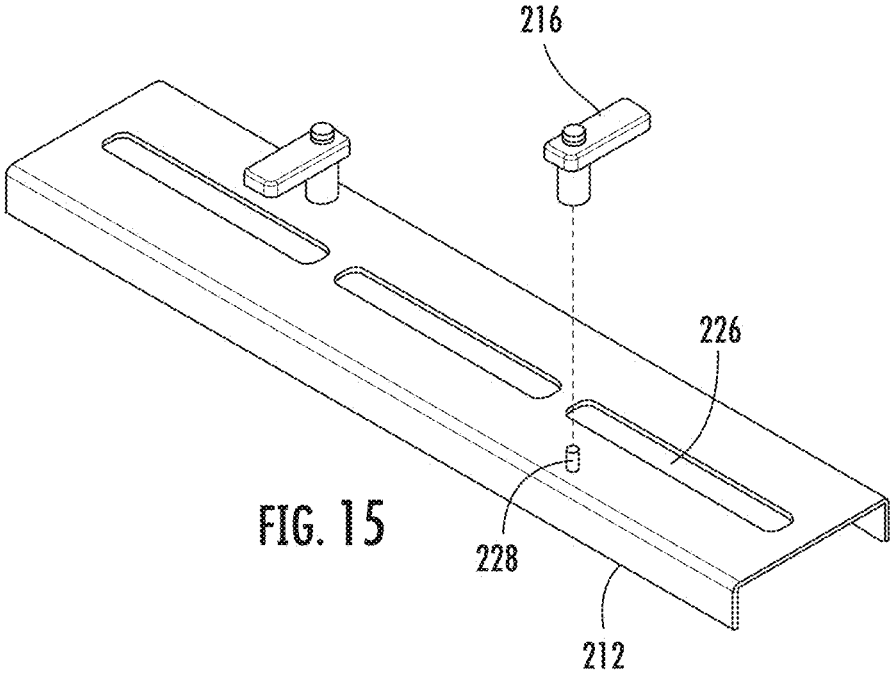
FIG. 15 is a perspective view of the rail bottom of FIG. 14, wherein the rail top assembly is omitted.
Figure 17:
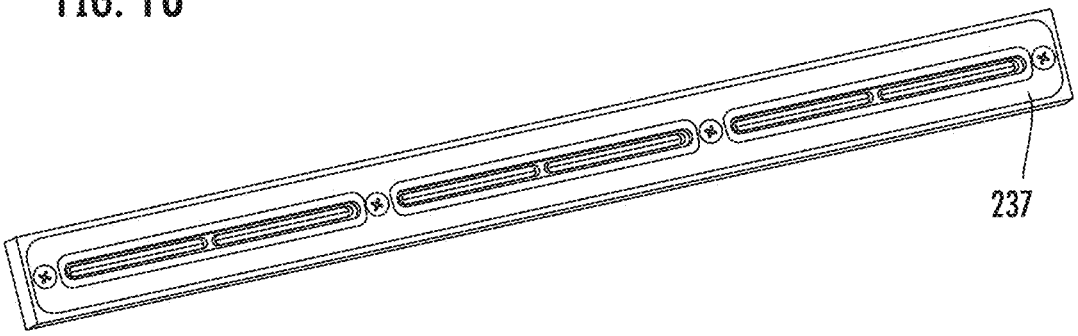
FIG. 17 shows a bottom view of the rail top assembly of FIG. 14.
Figure 18:
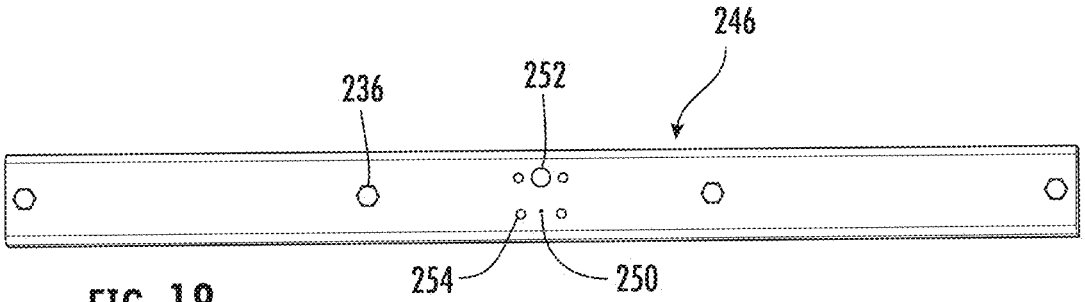
FIG. 18 is a top view of the rail top of FIG. 14.

FIG. 15 is a perspective view of the rail bottom 212 of FIG. 14, wherein the rail top assembly 214 is omitted for a better understanding of the invention. It can be seen that the rail bottom 212 includes three slots or gas distribution openings 226. The three slots 226 are aligned end-to-end. However, in contrast to the first embodiment, the slots 226 extend down the middle of the rail bottom 212. The slots 226 extend along the longitudinal center of the rail bottom 212. A stud 228 is shown secured to the rail bottom 212 via welding or other means. The stud 228 includes threaded upper opening to receive a respective fastener or screw 230 for securing a respective rotating locking arm 216. An orientation stud (not shown), similar to stud 32 of the first embodiment, may be included on the rail bottom 212 to be received by the rail top assembly 214. The gassing element alignment studs 34 used in the first embodiment may be used in the second embodiment, but are not necessary. Four fasteners or nuts 236 are shown on the rail top assembly 214. FIG. 17 shows four fasteners 237 which extend through the rail top assembly 214 including the through holes 248 of the top rail 246, and are secured by respective fasteners or nuts 236. The gas attachment 218 includes a single port block 238 and a port fitting 240.

Figure 16:
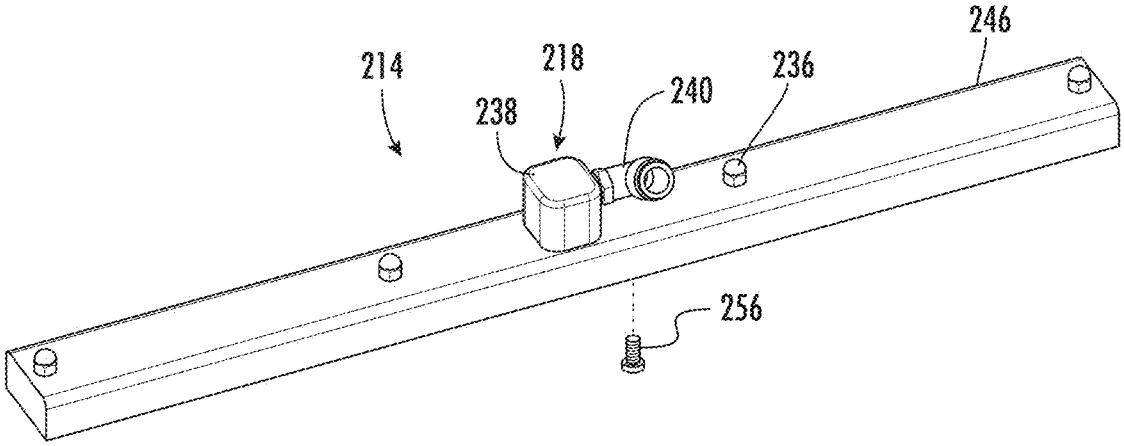
FIG. 16 shows a perspective view of the rail top assembly shown in FIG. 14.
Figure 19:
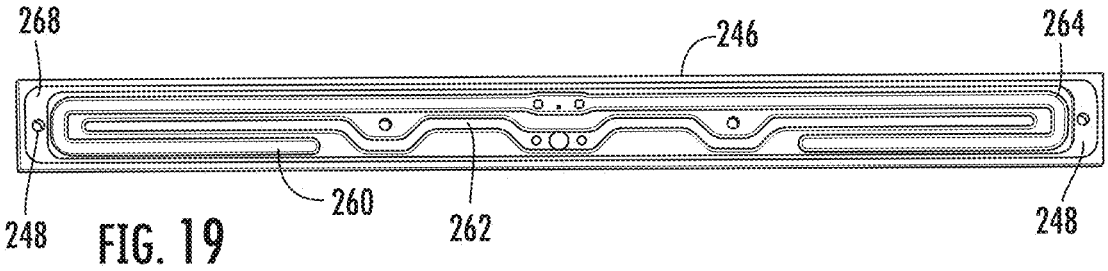
FIG. 19 is a bottom view of the rail top of FIG. 14.

FIG. 16 shows a perspective view of the rail top assembly 214 shown in FIG. 14. The rail top 246 includes four through-holes 248 which receive a respective fastener 236. FIG. 17 shows a laminar flow port opening 250 and an accelerated flow port opening 252 extend through the top surface of the rail top 246. Through-holes 254 receive a respective fastener 256 for securing the port block 238 to the rail top 246. FIG. 19 shows a bottom view of the rail top 246. Blind bores 58 provided in the rail top 46 to receive a respective orientation stud 32, as shown in the first embodiment, are not required for the second embodiment. The rail top 246 includes a laminar flow channel 260 and an accelerated flow channel 262. The accelerated flow channel 262 extends generally along a center longitudinal axis of the rail top 246. The laminar flow channel 260 extends generally around the accelerated flow channel 262. The rail top 246 includes an inner landing or seat 264, and an outer landing or seat 268. Each seat is shown forming a generally rectangular shape. However, unlike the first embodiment, each of the four corners 270 may be formed with the same radius 272. It is not necessary to form an orientation or keying feature as described in the first embodiment for receiving the various components.

Figure 20:
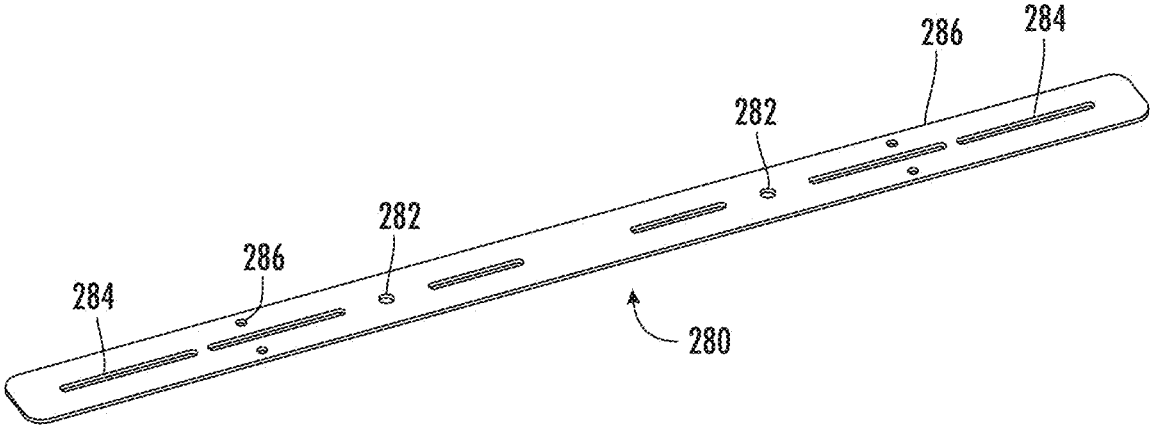
FIG. 20 shows a perspective view of the solid baffle.

FIG. 20 shows a perspective top view of the solid baffle 280 having through-holes 282 which receive the fasteners 237. The solid baffle 280 may be made of stainless steel and includes six accelerated gas flow slots 284 and four laminar gas flow openings 286 having a small orifice. In one embodiment, the opening 286 each provide approximately a 2.5 mm orifice. The solid baffle seals and separates the accelerated and laminar chambers 260, 262.

Figure 21:
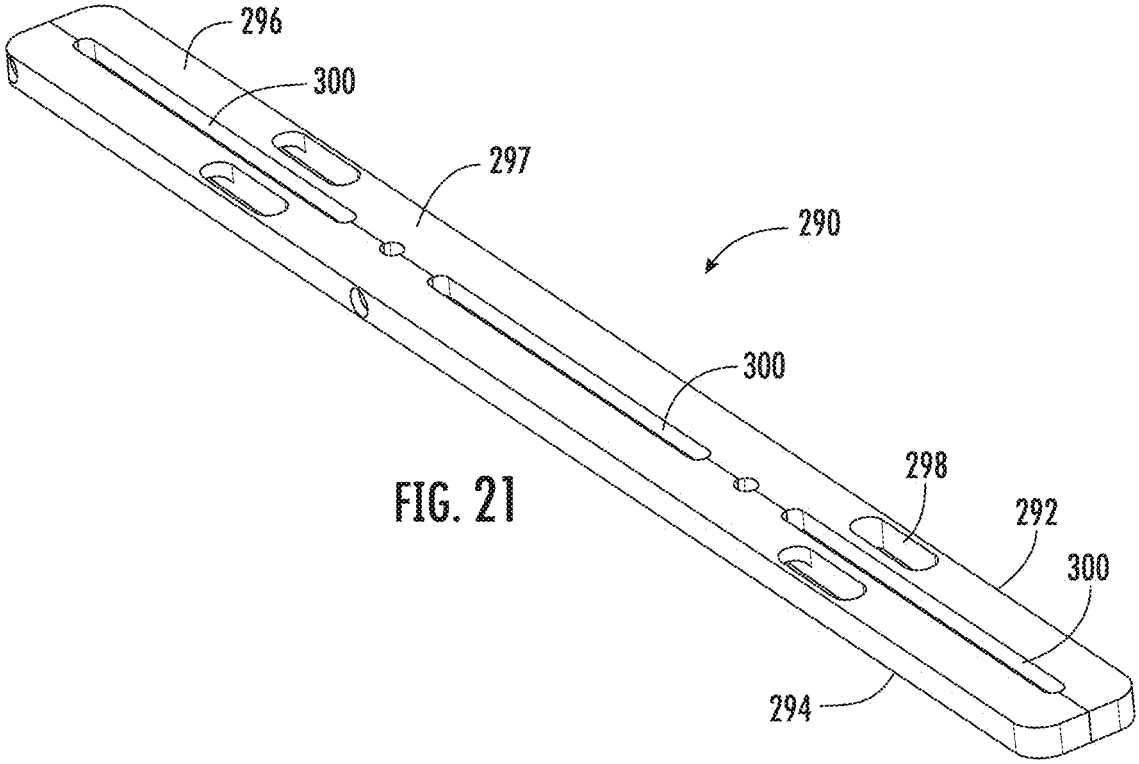
FIG. 21 shows a perspective top view of the insert assembly.
Figure 22:
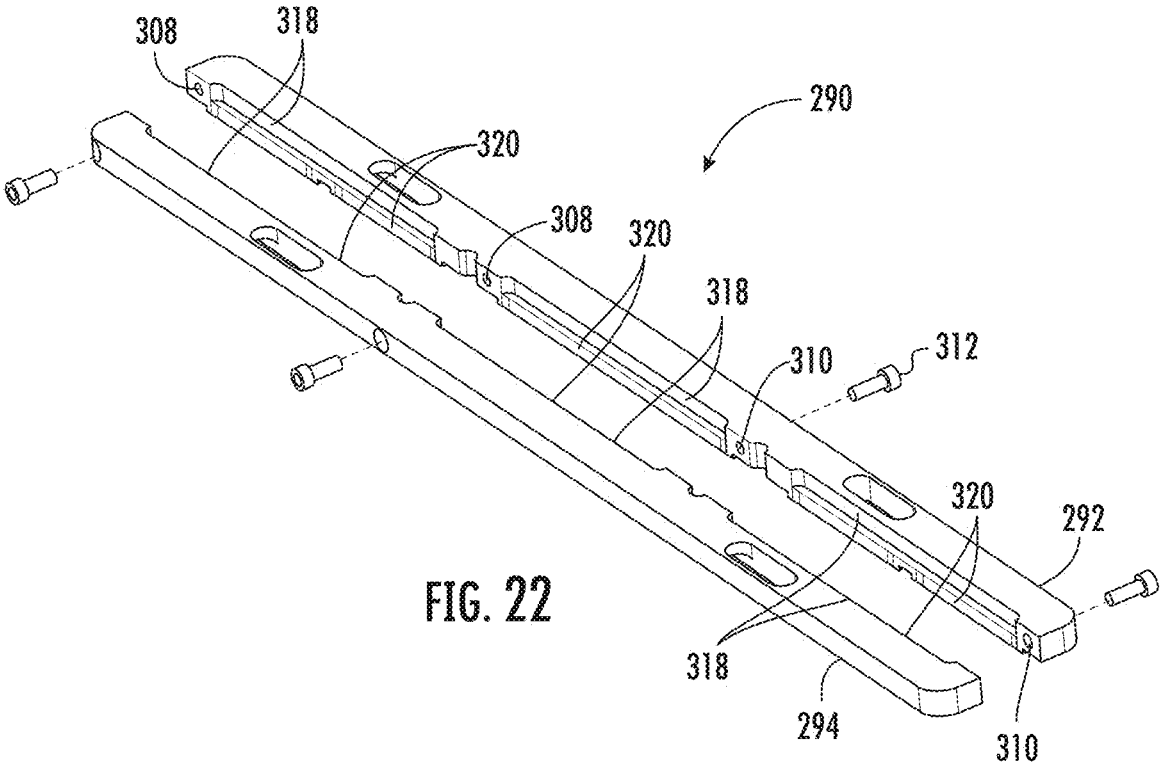
FIGS. 22 and 23 are top exploded view of the insert assembly of FIG. 21.
Figure 23:
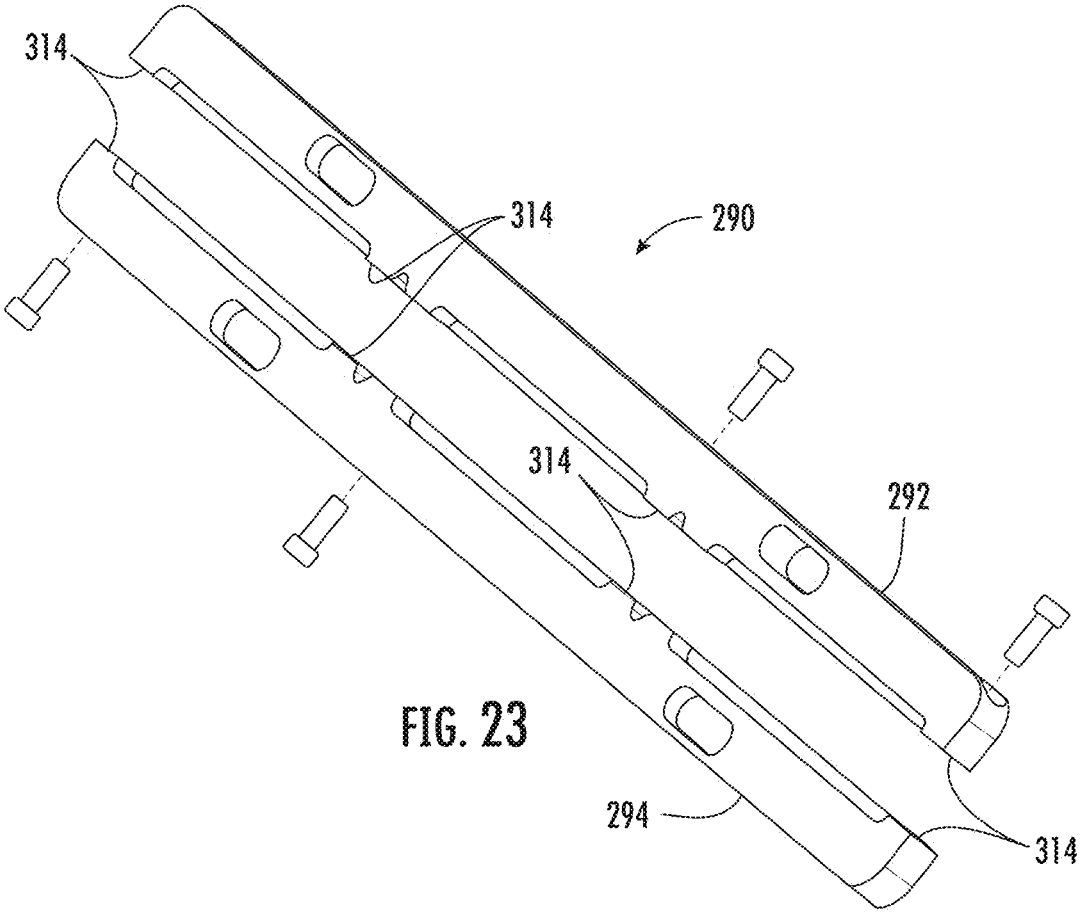
Figure 24:
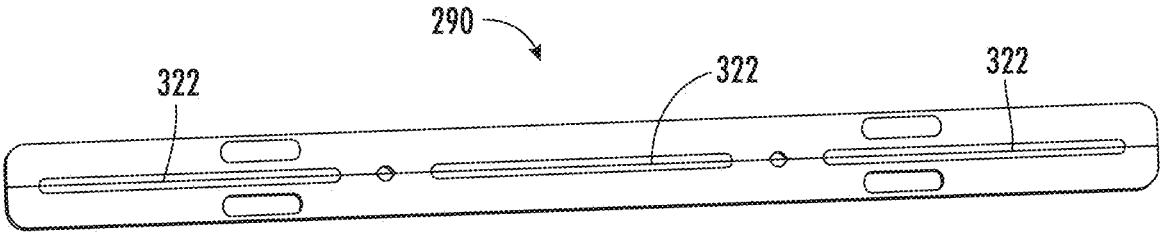
FIG. 24 is a top view of the insert assembly of FIG. 21.
Figure 25:
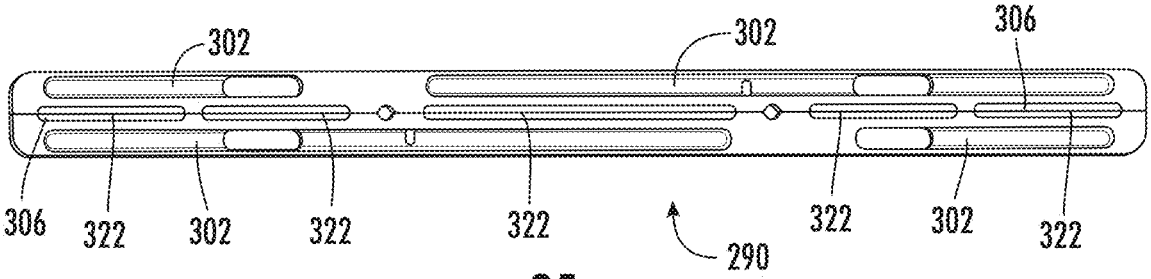
FIG. 25 shows a bottom view of the insert assembly of FIG. 21.

FIG. 21 shows a perspective top view of the insert assembly 290 which includes a first portion 292 and a second portion 294. The insert assembly 290 forms a top surface 296. Openings 297 are provided at the top surface 296 and receive respective fastener 237. Four input slot 298 for receiving gas having laminar flow is provided in the top surface 296. Three input slots 300 for receiving gas having an accelerated flow are provided in the top surface 296. FIG. 24 shows a bottom perspective view of the insert assembly 290 and shows that the laminar flow input slots 298 open to laminar flow chambers 302. The three input slots 300 merge into five output slots 306 for the gas having accelerate flow to exit the insert assembly 290. FIGS. 22 and 23 are top exploded views of the insert assembly 290 and shows two threaded openings 308 in the first portion 292 and two through openings 310 in the first portion 292. The second portion 294 is also provided with two threaded openings 308 and two through openings 310. The first portion 292 and the second portion 294 are secured together via fasteners 312. The upper portion of the insert assembly 290 includes six pairs of abutting walls 314 which form the three input slots 300 and two openings 297. The upper portion of the insert assembly 290 includes three sets of opposed upper facing walls 318 spaced apart a first distance. The lower portion of the insert assembly 290 includes five sets of lower facing walls 320 spaced apart so as to form a slit 322 having a width of about 0.25 mm. Although the insert assembly 290 may take other forms, it is desired that the insert assembly 290 channel the incoming gas having an accelerated flow to pass through slits 322 having a width of approximately 0.25 mm or in a range of 25 mm to 1 mm. The laminar gas flow openings 286 of the solid baffle 280 are aligned with the laminar flow input slots 298 of the insert assembly 290.

The four laminar gas flow openings 286 and the six accelerated gas flow slots 284 of the solid baffle 280 are aligned with the respective laminar openings and accelerated openings of the insert assembly 290. The four laminar gas flow openings 286 more evenly discharge laminar flow on either side of the accelerated flow from the slit 322.

Figure 26:
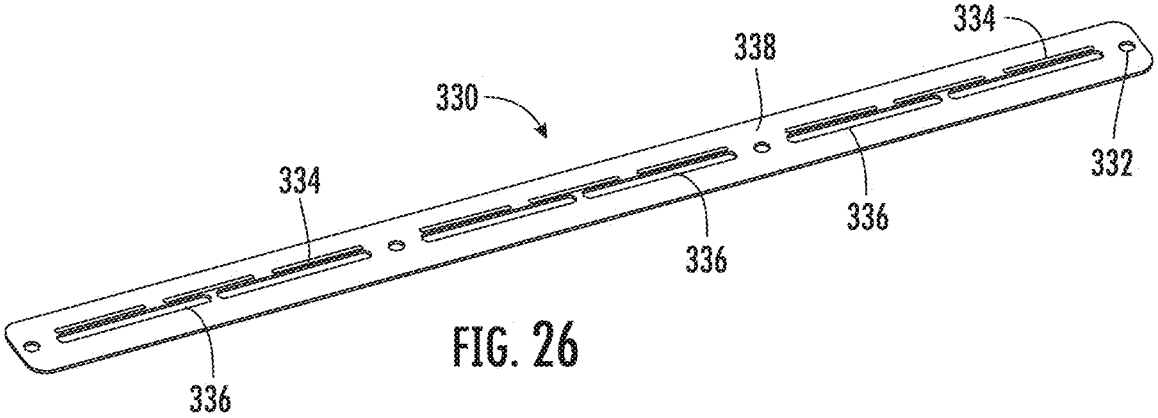
FIG. 26 shows a top perspective view of the gassing element or wire screen.
Figure 27:
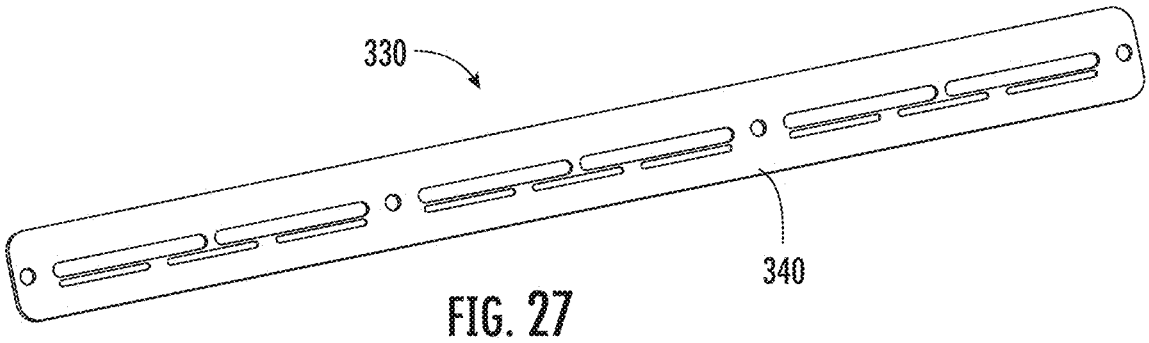
FIG. 27 is a bottom view of the gassing element or wire screen.

FIG. 26 shows a top perspective view of the gassing element or wire screen 330. Four through-holes 332 are provided for receiving a respective fastener 237. Three sets of three slots 334 are provided for gas having laminar flow. Three sets of two slots 336 are provided for gas having accelerated flow. The accelerated flow slots 336 are wider than the laminar flow slots 334 and extend generally centrally along the longitudinal axis of the gassing element 130. The laminar flow slots 334 extend generally offset from the accelerated flow slots 336. The gassing element 330 includes a top layer 338 and a bottom layer 340 of stainless steel mesh and may be secured together via welding or the like. The top layer 338 and the bottom layer 340 define a similar perimeter dimension, however, the bottom layer 340 does not include the slots 334, 336. The top layer 138 provides a denser media or less porous media than the bottom layer 340 and is a gas resistant media. For example, the top layer 338 is 5-ply mesh while the bottom layer 340 is 2-ply mesh. The purpose and construction of the 5-ply layer 338 and the finer 2-ply mesh layer 340 is similar to that in the first embodiment. FIG. 27 is a bottom perspective view of the gassing element 330 and the slots 334, 336 of the top layer 338 may be seen through the bottom layer 340.

The accelerated flow of the insert assembly 290 is aligned with the accelerated flow of the gassing element 330 located below the insert assembly 290. Laminar flow of the insert assembly 290 is only partially aligned with the gassing element 330.

Figure 28:
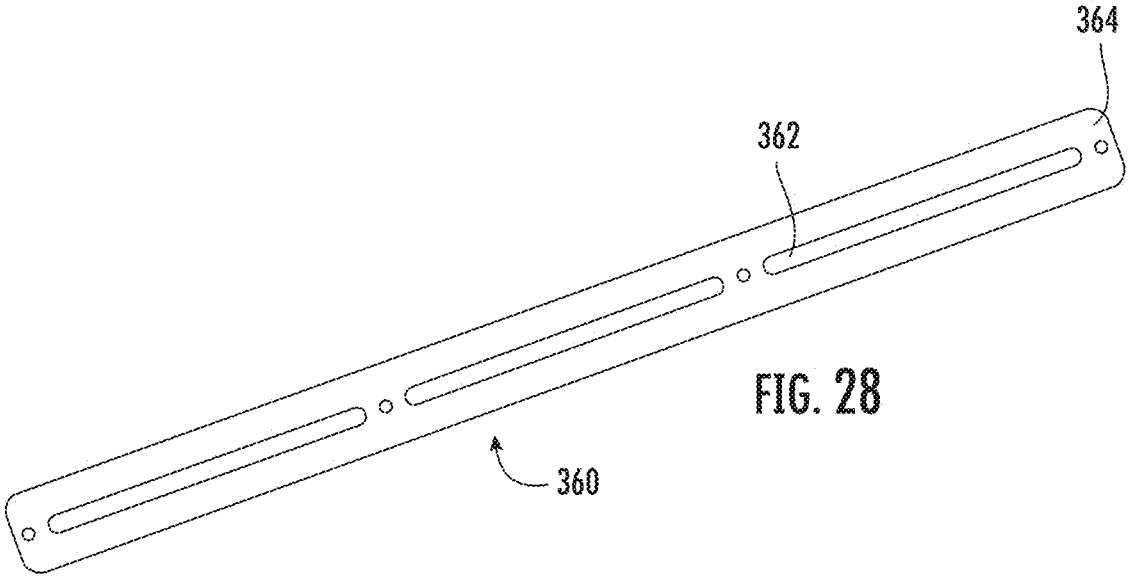
FIG. 28 is a top view of the frame.
Figure 29:
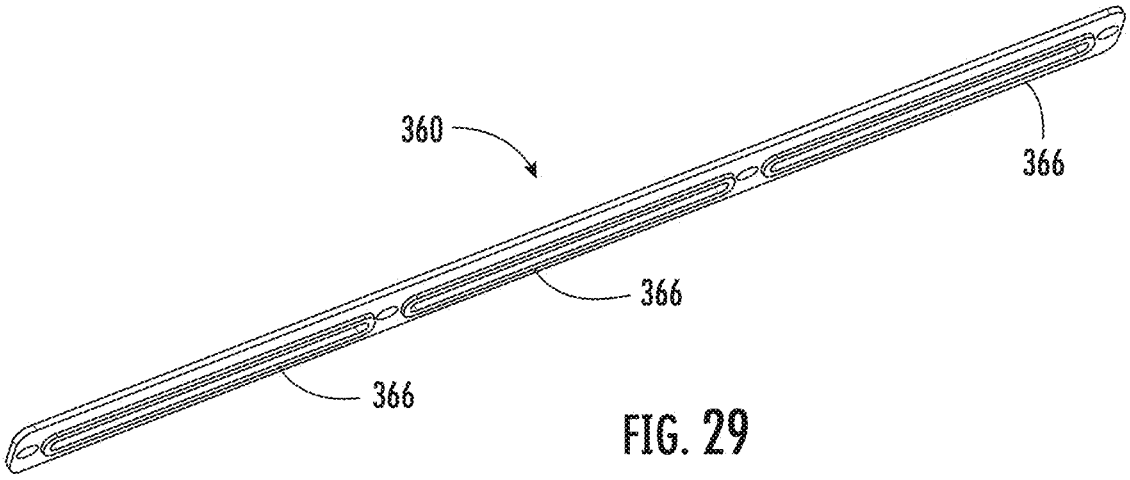
FIG. 29 is a bottom perspective view of the frame.

FIG. 28 is a top perspective view of the frame 360. The frame 360 includes three gas distribution slots or openings 362 which extend generally along the central longitudinal axis of the frame 360. Four openings 364 are provided for receiving the respective fastener 237. FIG. 29 is a bottom perspective view of the frame 360 and shows the downward depending flanges 366 which conforms to the respective slot 362.

The three gas distribution slots or openings 362 are centrally located and aligned with the accelerated flow from above.

Figure 31:
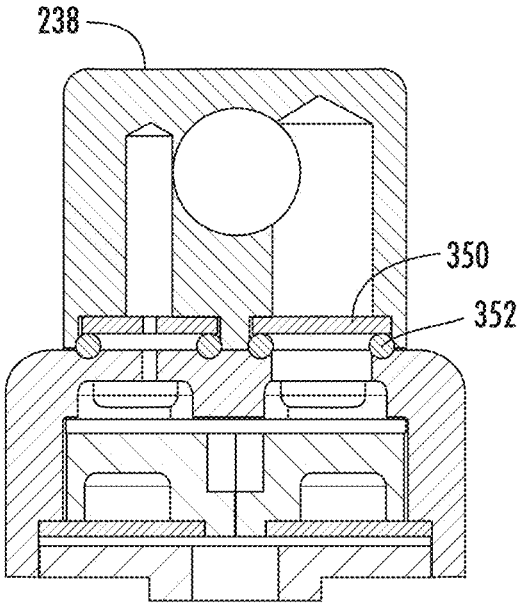
FIG. 31 is a partial enlarged view of FIG. 30.
Figure 30:
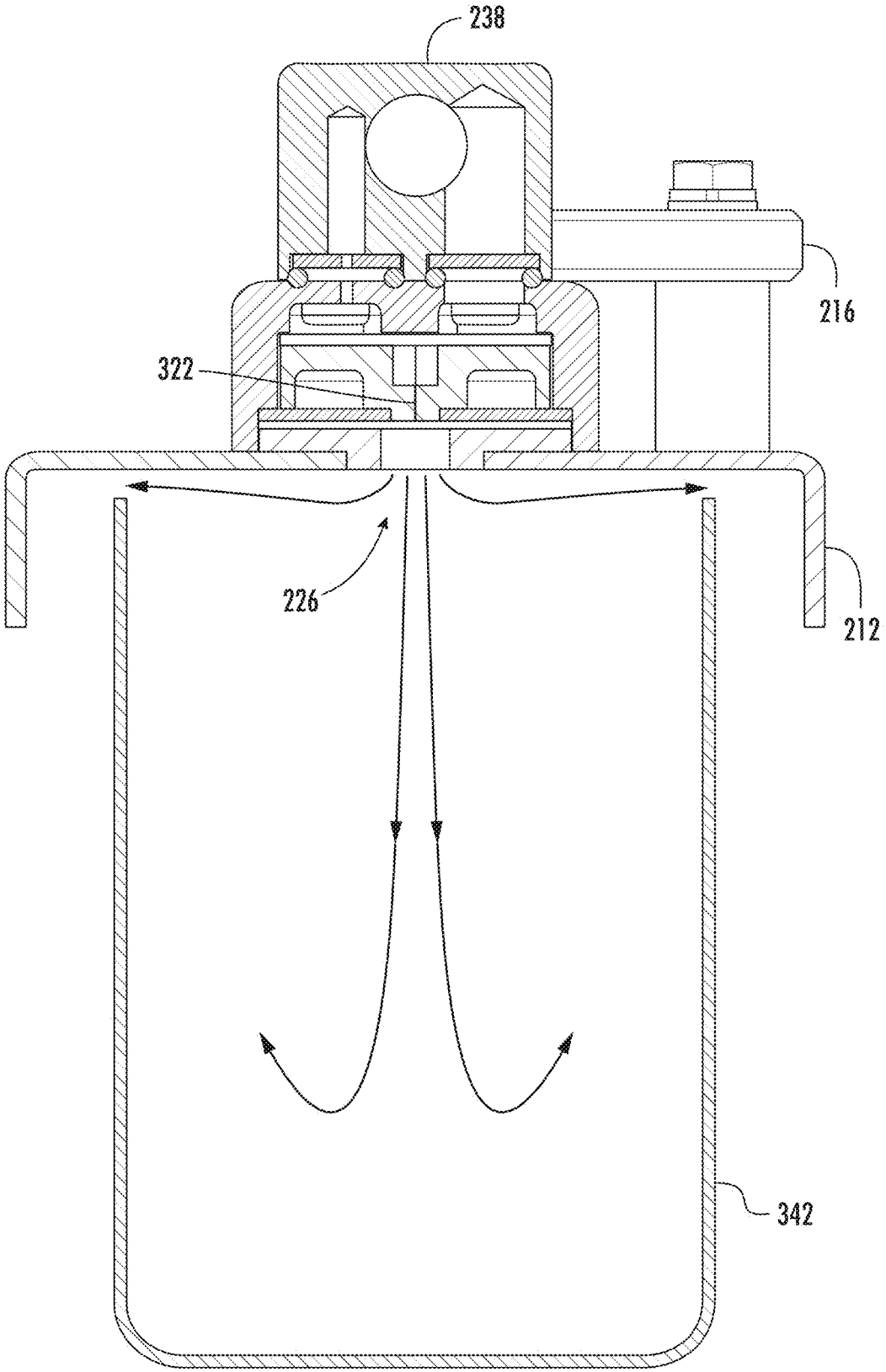
FIG. 30 is a cross section of the gassing rail assembly of FIG. 14 taken through the gas attachment, but including a cross section of a container.

FIG. 30 is a cross section of the gassing rail assembly 210 of FIG. 14 taken through the gas attachment 218, but including a cross section of a container 342. FIG. 31 is a partial enlarged view of FIG. 30.

The single port block 238 includes a gas inlet 400 which couples to the port fitting 240. The gas inlet 400 is coupled within the single port block 238 to a laminar port 402 and an accelerated port 404. The diameter of the accelerated port 238 is larger than the diameter of the laminar port 402 so as to control the ratio of gases as described in the first embodiment. The accelerated port 238 communicates with an accelerated outlet 406 having a port block baffle 350 and O-ring 352. The port block baffle 350 has a construction similar to the port block baffle 150 of the first embodiment. The laminar port 402 communicates with a laminar outlet 408 having a laminar port block baffle 410 and O-ring 352. The laminar port block baffle 410 is made of stainless steel and has an aperture of approximately 2.5 mm. The laminar port block baffle 410 contributes to the setting of the ratio of gases.

A preferred ratio is about 80% accelerated flow and 20% laminar flow as leaving the port block. However, a range of effective ratio includes 60/40% to 85/15%.

The single port block 238 is designed to split the gas source into two with the desirable ratio. The single port block 238 is coupled to a source of Nitrogen or the like, having a flow rate of about 300-400 CFH. The gas source (not shown), coupled to single port block 238, is regulated in a manner as one skilled in the art will appreciated. Where the source of gas is about 400 CFH, the aperture in the laminar port block baffle 410 regulates the source to direct about 100 CFH to the laminar port and 300 CFH to the accelerated port.

The FIG. 30 does not show nor require the gasket 154 of the first embodiment which seals the insert assembly 90 to the rail bottom 12.

It will be appreciated that the gassing rail assembly 210 provides gas having an accelerated flow from the slits 322 of the insert assembly 290 and exits the gas distribution opening 226 in the rail bottom 212. The gas having a laminar flow, provided generally from the 5-ply mesh of the gassing element 130, exits the gas distribution opening 26 generally surrounding the gas having accelerated flow, as depicted in FIGS. 11-13. The laminar flow surrounds the accelerated flow in a cloud like manner. The laminar flow is generally slow and smooth in comparison to the accelerated flow which is somewhat turbulent. The accelerated flow draws in laminar flow, instead of drawing in air. The laminar flow acts as a shield or blanket around the accelerated flow. The laminar flow tends to stabilize the accelerated flow.

The purpose of the mesh baffle is to slow downward flow and allow more even downward distribution in a pattern similar to the elongated horizontal laminar and accelerated passages of the rail top 46. The solid rail bottom 12 blocks the downward flow and forces the laminar flow of gas laterally within the 5-ply mesh, until it reaches the perimeter of the three longitudinal accelerated flow slots in the insert and exits the bottom rail the gas distribution opening. However, the slots of the element for accelerated flow of gas are aligned with the gas distribution opening in the rail bottom 12. Unlike the prior art, the present invention provides both laminar flow and accelerated flow at the same time.

The second embodiment requires only a single port and related tubing and mounting hardware. This is accomplished by the design of the rail top and case and the port block. Further, the gas distribution openings 226 extend along a centrally located longitudinal axis of the rail bottom 212. The rail top provides the laminar chamber along both sides of the accelerated chamber. Still further, a gasket is not required. It provides greater ease of assembly. There are less knobs, provides ease of cleaning and a high efficiency.

Both of the embodiments disclosed are able to penetrate a tall empty container up to approximately 9 inches tall. This is accomplished by using the disclosed ratio, and producing the laminar flow of gas which is largely due to the 5-ply mesh and producing the accelerated flow of gas which is largely due to the slit. The gassing rail assemblies disclose provide excellent purging for non-powder product, such as peanuts, chips, cheese puffs, and the like.

The invention claimed is:

1. A gassing rail apparatus to be used in a food packaging conveyor system, the gassing rail apparatus adapted to be coupled to a first gas source and a second gas source, comprising:

a rail top, the rail top having an upper portion with a laminar flow port opening and an accelerated flow port opening, and a lower portion having a laminar flow channel and an accelerated flow channel, the channels extending longitudinally in a parallel arrangement, the laminar flow port opening coupled to the laminar flow channel and the accelerated flow port opening coupled to the accelerated flow channel;

a first gas port coupled to the laminar flow port opening, the first gas port is adapted for coupling to a first gas source;

a second gas port coupled to the accelerated flow port opening, the second gas port is adapted for coupling to a second gas source;

an insert assembly located below the rail top and having an upper portion and a lower portion, the upper portion includes a laminar flow input aligned with the laminar flow channel, and a slit extending parallel to the laminar flow input and being generally aligned with the accelerated flow channel, the slit having an inlet in the upper surface of the insert assembly and an outlet in the lower portion, a longitudinally extending laminar chamber is provided in the lower portion and is in fluid communication with the laminar flow input;

a gassing element located below the insert assembly and having a layer of gas resistant media of stainless-steel mesh, the gassing element includes one or more slots for laminar flow configured to be at least partially aligned with the laminar chamber located above, and one or more slots for accelerated flow being aligned with the slit located above;

a rail bottom located below the gassing element, the rail bottom having at least one gas distribution slot, the at least one gas distribution slot extending along the longitudinal axis of the rail bottom, and the at least one gas distribution slot being aligned with the accelerated flow slots of the gassing element and at least partially blocks the laminar flow slots of the gassing element;

wherein the gas flowing through the slit produces a high speed accelerated flow, and the flow of laminar gas blocked by the rail bottom forces the laminar gas flow laterally within the layer of gas resistant media of the gassing element with the effect of surrounding the accelerated gas exiting the gas distribution slot, wherein the accelerated gas draws in laminar gas and does not draw in undesirable air, and the first gas source provides about-15-25% of all the gas provided to the gassing rail apparatus and the second gas source provides about-75-85% of all the gas provided to the gassing rail apparatus.

2. The gassing rail apparatus of claim 1, wherein the first gas source preferably provides 20% of the gas provided to the gassing rail apparatus and the second gas source preferably provides 80% of the gas provided to the gassing rail apparatus.

3. The gassing rail apparatus of claim 1, further comprising a mesh baffle located between the rail top and the insert assembly, wherein the mesh baffle slows downward flow of gas and provides a more even downward distribution in a pattern, the pattern being similar to the elongated horizontal laminar flow channel and accelerated flow channels of the top rail.

4. The gassing rail apparatus of claim 3, wherein the top rail includes an inner seat, an intermediate seat and an outer seat, each seat comprising a generally rectangular shape, wherein two of the corners are formed with a first radius and the other two corners are formed with a second radius, so as to form an orientation or keying feature, the mesh baffle includes first and second radius and is received by the inner seat, the insert assembly includes first and second radius and is received by the intermediate seat, and the gassing element includes first and second radius and is received by the outer seat.

5. The gassing rail apparatus of claim 4, wherein fasteners extend through openings in the rail top and mesh baffle and are received in threaded openings in the insert assembly, whereby the assembled components comprise the rail top assembly.

6. The gassing rail apparatus of claim 5, wherein the rail bottom includes gassing element alignment studs extending from an upper surface of the rail bottom, and the gassing element includes through-holes for receiving the alignment studs for providing alignment with the rail bottom.

7. The gassing rail apparatus of claim 6, wherein the rail bottom includes a plurality of rotating locking arms which secure the rail top assembly to the rail bottom, with the gassing element located between the rail bottom and rail top assembly.

8. The gassing rail apparatus of claim 7, wherein the rail bottom includes at least one orientation stud, and the rail top assembly includes at least one respective blind bore for receiving the respective orientation stud, whereby the rail top assembly is aligned with the rail bottom.

9. The gassing rail apparatus of claim 1, wherein the gassing element further comprises a 2-ply layer of stainless-steel mesh located below a 5-ply layer of stainless-steel mesh, the two layers of stainless-steel mesh being spot welded together, wherein the 2-ply layer provides a barrier between product and the container, the barrier preventing the container from coming into contact with the slit of the insert assembly, and further wherein the slit has a width in a range of about 0.25 mm to 1 mm.

10. The gassing rail apparatus of claim 1, wherein the insert assembly comprises a first longitudinally extending portion and a second longitudinally extending portion, the first and second portions having respective facing walls which, when assembled, form the slits, and the first and second longitudinally extending portions are secured by fasteners, whereby the insert assembly is configured to be easily disassembled for cleaning.

11. A gassing rail apparatus to be used in a food packaging conveyor system, comprising:

a rail top, the rail top having an upper portion with a laminar flow port opening and an accelerated flow port opening, and a lower portion having a laminar flow channel and an accelerated flow channel, the accelerated flow channel extending generally centered along the longitudinal axis of the rail top, the laminar flow channel generally extending around the accelerated flow channel, the laminar flow port opening coupled to the laminar flow channel and the accelerated flow port opening coupled to the accelerated flow channel;

a gas port coupled to the laminar flow port opening and the accelerated flow port opening, the gas port is adapted for coupling to a gas source;

an insert assembly located below the rail top and having an upper portion and a lower portion, the upper portion includes a laminar flow input aligned with the laminar flow channel, and a slit extending and being centered along the longitudinal axis of the insert assembly, the slit being generally aligned with the accelerated flow channel, the slit having an inlet in the upper surface of the insert assembly and an outlet in the lower portion, and longitudinally extending laminar chambers are provided in the lower portion located on opposite sides of the slit and is in fluid communication with the laminar flow input;

a gassing element located below the insert assembly and having a layer of gas resistant media of stainless-steel mesh, the gassing element includes one or more slots for laminar flow which are at least partially aligned with the laminar chambers located above, and one or more slots for accelerated flow, the one or more slots aligned with the slit located above;

a rail bottom located below the gassing element, the rail bottom having at least one gas distribution slot, the at least one gas distribution slot extending along the longitudinal axis of the rail bottom, and is aligned with the accelerated flow slots of the gassing element, the at least one gas distribution slot at least partially blocks the laminar flow slots of the gassing element;

wherein the gas flowing through the slit produces a high speed accelerated flow, and the flow of laminar gas blocked by the rail bottom forces the laminar gas flow laterally within the layer of gas resistant media of the gassing element with the effect of surrounding the accelerated gas exiting the gas distribution slot, wherein the accelerated gas is configured to draw in laminar gas and not undesirable air.

12. The gassing rail apparatus of claim 11, further comprising a frame having at least one gas exit slot, the gas exit slot having a downward depending flange which is received by the rail bottom and together form the at least one gas distribution slot.

13. The gassing rail apparatus of claim 12, further comprising a solid baffle located between the rail top and the insert assembly, the solid baffle being made of stainless steel and includes at least one accelerated gas flow slot and at least one laminar gas flow opening, the laminar gas flow opening comprising a small orifice, the solid baffle seals and separates the accelerated and laminar chambers of the rail top.

14. The gassing rail apparatus of claim 13, wherein the rail top includes an inner seat and an outer seat, each seat comprising a generally rectangular shape, the solid baffle and insert assembly are received by the inner seat, and the gassing element and frame are received by the outer seat.

15. The gassing rail apparatus of claim 13, wherein fasteners extend through the frame, gassing element, insert assemble, solid baffle and rail top and provide the rail top assembly, and the rail bottom includes a plurality of rotating locking arms which secure the rail top assembly to the rail bottom, with the gassing element located between the rail bottom and rail top assembly.

16. The gassing rail apparatus of claim 11, wherein the gassing element further comprises a 2-ply layer of stainless-steel mesh located below a 5-ply layer of stainless-steel mesh, the two layers of stainless-steel mesh being spot welded together, wherein the 2-ply layer provides a barrier between product and the container, the barrier preventing the container from coming into contact with the slit of the insert assembly, and wherein the slit has a width in a range of 0.25 mm to 1 mm.

17. The gassing rail apparatus of claim 11, wherein the insert assembly comprises a first longitudinally extending portion and a second longitudinally extending portion, the first and second portions having respective facing walls which when assembled form the slits, the first and second longitudinally extending portions are secured by fasteners, whereby the insert assembly is configured to be easily disassembled for cleaning.

18. The gassing rail apparatus of claim 11, further comprising a gas attachment, the gas attachment comprising:

a single port block having a gas inlet in fluid communication with a port fitting, the gas inlet is in fluid communication with a laminar port and an accelerated port, the accelerated port communicates with an accelerated outlet, the laminar port communicates with a laminar outlet, the diameter of the accelerated port is larger than the diameter of the laminar port so as to control the ratio of gases, whereby about 60-85% of gas exits the accelerated outlet and about 15-40% of the gas exits the laminar outlet, and the preferable ratio is 4 to 1.

19. A gas attachment for a gassing rail apparatus to be used in a food packaging conveyor system, comprising:

a single port block having a gas inlet in fluid communication with a port fitting, the gas inlet is in fluid communication with a laminar port and an accelerated port, the accelerated port communicates with an accelerated outlet, the laminar port communicates with a laminar outlet, the diameter of the accelerated port is larger than the diameter of the laminar port so as to control the ratio of gases, whereby between 60 to 85% of all of the gas exits the accelerated outlet and between 15 to 40% of all of the gas exits the laminar outlet, and preferably the ratio is 4 to 1.

20. The gas attachment of claim 19, further comprising a port block baffle and O-ring located at the accelerated outlet, the laminar outlet having a laminar port block baffle and O-ring located at the laminar outlet, the laminar port block baffle is made of stainless steel and includes an aperture of approximately-2.5 mm, wherein the laminar port block baffle contributes to the setting of the ratio of gases.

21. A method of displacing undesirable gases from an empty container, the method comprising:

providing a gassing rail apparatus having a source of flushing gas, a rail top, an insert assembly having a slit, a gassing element having a gas resistant media, and a rail bottom having a gas distribution outlet which defines a perimeter which surrounds a center, wherein the slit is aligned with the center of the gas distribution outlet, and the rail top, insert assembly, gassing element and rail bottom form flow channels;

directing a portion of the flushing gas through the slit to produce an accelerated flow of flushing gas;

directing another portion of the flushing gas through the gas resistant media to produce a laminar flow of flushing gas;

directing the accelerated flow of flushing gas to exit generally at the center of the gas distribution outlet;

directing the laminar flow of flushing gas to exit the gas distribution outlet along a perimeter of the gas distribution outlet and concurrently surrounding the accelerated flow of flushing gas exiting the gas distribution outlet;

wherein the accelerated gas tends to draw in laminar gas and not undesirable air.

22. The method of claim 21, further comprising the step of:

routing, concurrent with the directing, the source of flushing gas through the flow channels to provide between 15 to 25% of laminar flow for all of the flushing gas and between 75 to 85% of accelerated flow for all of the flushing gas.

* * * * *